United States Patent [19]

Jamison, deceased

[11] 4,044,711

[45] Aug. 30, 1977

[54] AERIAL DISTRESS MARKER

[75] Inventor: Leon L. Jamison, late of Wilmington, Del., by Barbara A. Jamison, administratrix, Wilmington, Del.

[73] Assignee: The Raymond Lee Organization, Inc., New York, N.Y. ; a part interest

[21] Appl. No.: 656,620

[22] Filed: Feb. 9, 1976

[51] Int. Cl.[2] ..... G09F 21/06

[52] U.S. Cl. ..... 116/124 B; 116/DIG. 8; 116/DIG. 9; 244/155 R; 343/18 B

[58] Field of Search ..... 116/124 B, 124 R, DIG. 8, 116/DIG. 9; 244/155 A, 155 R; 343/18 B

[56] References Cited

U.S. PATENT DOCUMENTS

| | | | |
|---|---|---|---|
| 2,842,090 | 7/1958 | Samwald | 116/124 B |
| 3,068,472 | 12/1962 | Dellaria | 343/18 B |
| 3,721,983 | 3/1973 | Sherer | 343/18 B |
| 3,874,325 | 4/1975 | Cocker | 116/124 B |
| 3,938,466 | 2/1976 | Cussman | 116/DIG. 9 X |
| 3,964,427 | 6/1976 | Murphy | 116/DIG. 9 |

*Primary Examiner*—Richard C. Queisser
*Assistant Examiner*—Charles Gorenstein
*Attorney, Agent, or Firm*—Howard I. Podell

[57] ABSTRACT

A distress marker assembly in the form of an inflatable balloon fastened to a cylinder of compressed helium or hydrogen gas, with a flexible line fixed at one end to the cylinder and at the other end to an anchor unit. The anchor unit is shaped with a clasp for fastening to a fixed object or the person of the user, and formed with a pair of flexible clamp jaws through which the line is fed out to the balloon, when inflated. The balloon is marked with a distinctive color and with large letters spelling out S.O.S. The balloon contains a quantity of metal oxide powder to serve as a radar reflector.

2 Claims, 6 Drawing Figures

AERIAL DISTRESS MARKER

SUMMARY OF THE INVENTION

My invention is a distress marker assembly in the form of an inflatable balloon fastened to a cylinder of compressed helium or hydrogen gas, with a flexible line fixed at one end to the cylinder and at the other end to an anchor unit. The anchor unit is shaped with a clasp for fastening to a fixed object or the person of the user, and formed with a pair of flexible damp jaws through which the line is fed out to the balloon, when inflated. The balloon is marked with a distinctive color and with large letters spelling out S.O.S. The balloon contains a quantity of metal oxide powder to serve as a radar reflector.

By means of my invention, distressed campers, hunters, military personnel and stranded boatsmen may attract attention and identify their location for searchers.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 5:
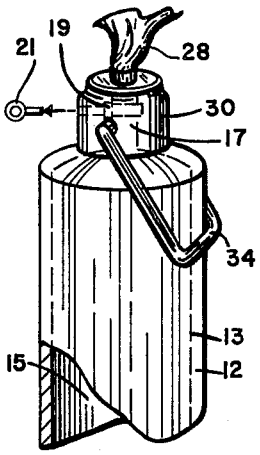
FIG. 5 is a detail perspective view of the cylinder unit.
Figure 1:
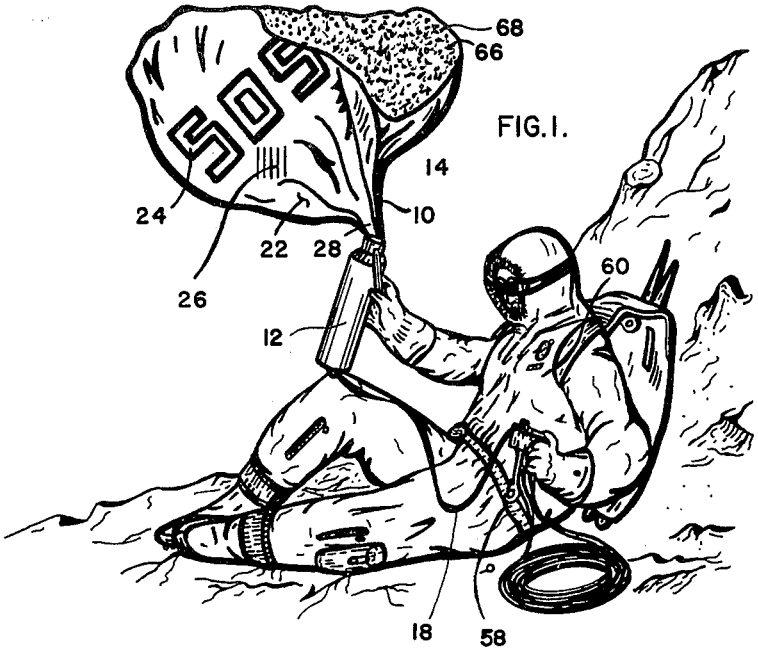
FIG. 1 is a perspective view of the invention being prepared for use.
Figure 6:
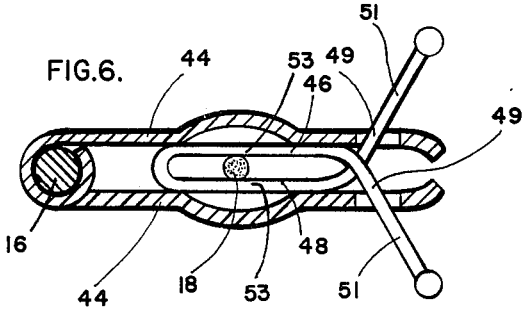
FIG. 6 is a sectional view of the clamps of the anchor unit, taken along line 6—6 of FIG. 5.
Figure 2:
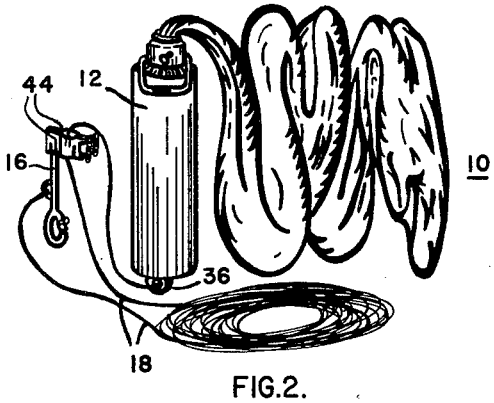
FIG. 2 is a perspective view of the invention.
Figure 3:
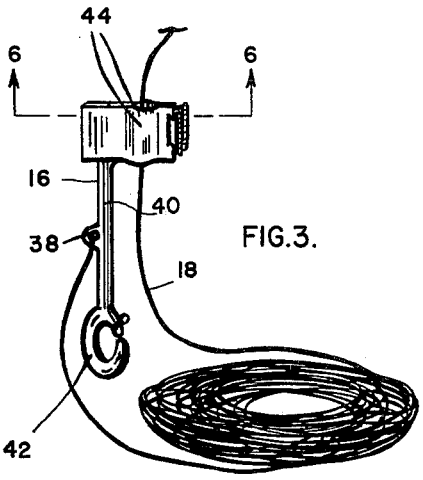
FIG. 3 is a perspective view of the anchor unit.
Figure 4:
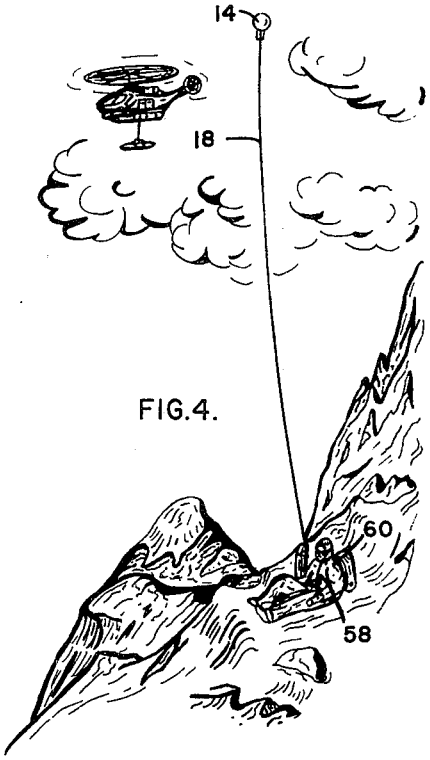
FIG. 4 is a perspective view of the invention in use.

Turning now descriptively to the drawings, in which similar reference characters denote similar elements throughout the several views, FIGS. 1–6 illustrate the distress balloon assembly 10 which consists of a cylinder unit 12 to which an inflatable balloon 14 is joined, an anchor unit 16, and a length of line 18 which joins the anchor unit 16 to the cylinder unit 12.

Balloon 14 is preferably of the type employed as weather balloons and is marked on its exterior surface 22 with distress insignis such as the letters "S.O.S.", said exterior surface 22 being preferably a bright red or orange color 26.

The neck 28 of the balloon 14 is joined to a collar 30 fitted at an end of the cylinder unit 12.

Cylinder unit 12 consists of a hollow cylinder 13 containing a compressed gas of lighter density than air, such as helium in the interior 15 of cylinder 13, with a passage 17 in cylinder collar 28 leading to balloon neck 28.

A valve 19 in collar 30 blocks passage 17, with a removable pin 21 snugly fitted in a radial hole in collar 30 actuating valve 19. Removal of pin 21 causes valve 19 to open to permit flow of the gas from the cylinder interior 15 through passage 17 and balloon neck 28 so as to inflate the balloon 14.

A handle 34 is rotatably mounted to the exterior of collar 30 for handling the cylinder unit 12 prior to, or during inflation of balloon 14.

Cylinder unit 12 is fitted externally with an eye 36 to which an end of a fexible line 18 is fastened. Line 18 is preferably of a length of sixty-one metres of heavy duty fishing line and is fastened at its other end to an eye 38 fixed on the shaft 40 of anchor unit 16.

Anchor unit 16 is formed of a shaft 40, with a first end 41 joined to an eye clasp 42 and with the opposed second end pivotably joined to a pair of clamp jaw members 44 projecting from shaft 40. Eye 38 is fixed to a side of the mid-section of the shaft 40.

Clamp jaw members 44 enclose and are fixed to a flat shaped clamp spring 46, formed of a U-shaped section 48, the legs 49 of which are bent at their end sections 51 to cross each other with end sections 51 projecting as grips beyond clamp jaw members 44 so that manual pressing of ends 51 together, separates the mid-section 53 of legs 49 from clamping contact with line 18 which passes between legs 49 of the clamp spring 46.

In use, the clasp 42 of anchor unit 16 is fastened about a fixed object or the clothing 58 of the user 60, who manipulates the grips 51 of spring clamp 46 to release sufficient length of line 18 between the inflated balloon 14 and the ground, when balloon 14 is inflated.

Balloon 14 may be filled with a small quantity of finely powdered light metal oxide 66 such as aluminum or magnesium oxide dust, so that the inflated interior 68 of the balloon 14 serves as a radar target, as the oxide dust is dispersed throughout the interior in the inflated state.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A distress kit for location of a person in distress by means of an inflatable balloon attached to the kit, comprising an inflatable balloon joined to a cylinder of pressurized gas of a density less than air, an anchor unit, and a flexible line joining the cylinder to the anchor unit, in which a quantity of fine metallic powder is located in the interior of the balloon, to serve as a radar marker when the balloon is inflated with the pressurized gas and the powder is dispersed throughout the balloon, and in which the anchor unit is formed of a member fitted with a first fastening means adaptable for fastening to an end of the flexible line, a second fastening means adaptable for clasping to an object apart from the assembly, and a third fastening means comprising means for clamping, under spring bias, a section of the line passing through the third fastening means, and third fastening means fitted with gripping means to permit manual adjustment of he clamping force of the said means about said section of the line.

2. A distress kit for location of a person in distress by means of an inflatable balloon attached to the kit, comprising an inflatable balloon joined to a cylinder of pressurized gas of a density less than air, an anchor unit, and a flexible line joining the cylinder to the anchor unit, in which a quantity of fine metal powder is located in the interior of the balloon, to serve as a radar marker when the balloon is inflated with the pressurized gas and the powder is dispersed throughout the balloon.

* * * * *